US006971836B2

(12) United States Patent
Carlsson

(10) Patent No.: US 6,971,836 B2
(45) Date of Patent: Dec. 6, 2005

(54) DEVICE AT LIFT TRUCKS

(75) Inventor: Hans Carlsson, Ljungby (SE)

(73) Assignee: SMV Lifttrucks AB, Markaryd (SE)

( * ) Notice: Subject to any disclaimer, the term of this patent is extended or adjusted under 35 U.S.C. 154(b) by 0 days.

(21) Appl. No.: 10/607,354

(22) Filed: Jun. 26, 2003

(65) Prior Publication Data

US 2004/0096306 A1 May 20, 2004

(30) Foreign Application Priority Data

Jul. 3, 2002 (SE) ..... 0202054

(51) Int. Cl.[7] ..... B66C 1/10
(52) U.S. Cl. ..... 414/685; 414/718
(58) Field of Search ..... 414/680, 685, 414/687, 718

(56) References Cited

U.S. PATENT DOCUMENTS 3,454,176 A 7/1969 Landeborg et al.
4,257,732 A * 3/1981 Staffanson ..... 414/685 X
4,549,845 A * 10/1985 Ramsey, Jr. ..... 414/680 X

FOREIGN PATENT DOCUMENTS

DE 2840646 A1 4/1980
GB 2013616 A 8/1979

* cited by examiner

*Primary Examiner*—Donald W. Underwood
(74) *Attorney, Agent, or Firm*—Tärolli, Sundheim, Covell & Tummino L.L.P.

(57) ABSTRACT

The present invention relates to a device at lift trucks, including a chassis (3) with a driving compartment (2) and a lifting device (9) for lifting goods. The lifting device (9) has two lifting arms (15, 16) of which rear portions (15*a*, 16*a*) are provided on the chassis (3) behind the driving compartment (2) by joints (19, 20) which permit a) pivoting of the lifting arms (15, 16) by lifting units (22, 23) in vertical planes (VP15, VP16) for moving goods in vertical directions and b) pivoting of the lifting arms (15, 16) by pivoting devices (28, 29) in horizontal planes (HP15, HP16) between inner positions (IL) in which the distance (Min) between their front portions (15*b*, 16*b*) or front tips (17*e*, 18*e*) of lifting members (17, 18) provided on the front portions (15*b*, 16*b*) is less than front portions of the chassis (3), and outer positions (YL) in which the distance (Max) between their front portions (15*b*, 16*b*) or between the front tips (17*e*, 18*e*) is greater than the width (B) of the front portions of the chassis (3).

41 Claims, 7 Drawing Sheets

DEVICE AT LIFT TRUCKS

FIELD OF THE INVENTION

The present invention relates to a device at lift trucks, comprising a chassis with a driving compartment and a lifting device for lifting goods, wherein the lifting device has two lifting arms of which rear portions are provided on the chassis behind the driving compartment by means of joints which permit pivoting of the lifting arms by means of lifting units in vertical planes for moving goods in vertical directions, and pivoting of the lifting arms by means of pivoting devices in horizontal planes for changing the distance and/or the angle between at least such front portions thereof or such lifting means provided on front portions thereof, which are adapted for fetching and delivering goods.

Lift trucks known from U.S. Pat. No. 3,454,176 have vertically pivotable lifting arms which are journalled behind the driving compartment and which are pivotable to some extent in horizontal directions. These lift trucks are said to have an advantageous distribution of the loads on the wheels, a robust and low fork structure and an improved reliability and field of view in forward direction. The field of view in forward direction however, is not particularly improved relative to prior art lift trucks, since the lifting arms are connected to each other at the front by means of a transverse beam, which prevents substantially pivoting thereof out of the field of view of the operator.

The object of the present invention has been to eliminate this problem, which is accomplished by providing the device according to the invention with the characterizing features of primarily subsequent claim 1.

Since the lifting arms are journalled in such joints and cooperate with such pivoting devices that they are pivotable from adjacent mutual positions in which front portions thereof are located within the chassis to mutual outer positions in which the front portions are situated outside the chassis, it is achieved that the lifting arms on one hand can be set to fetch small loads or reach into narrow spaces in loads to be fetched and on the other hand can be set to give a totally free field of view in forward direction and/or to fetch large or long loads.

The invention will be further described below with reference to the accompanying drawings, in which FIG. 1 is a perspective view of a lift truck according to the invention obliquely from behind and with a lifting device located in a lower position;

Figure 1:
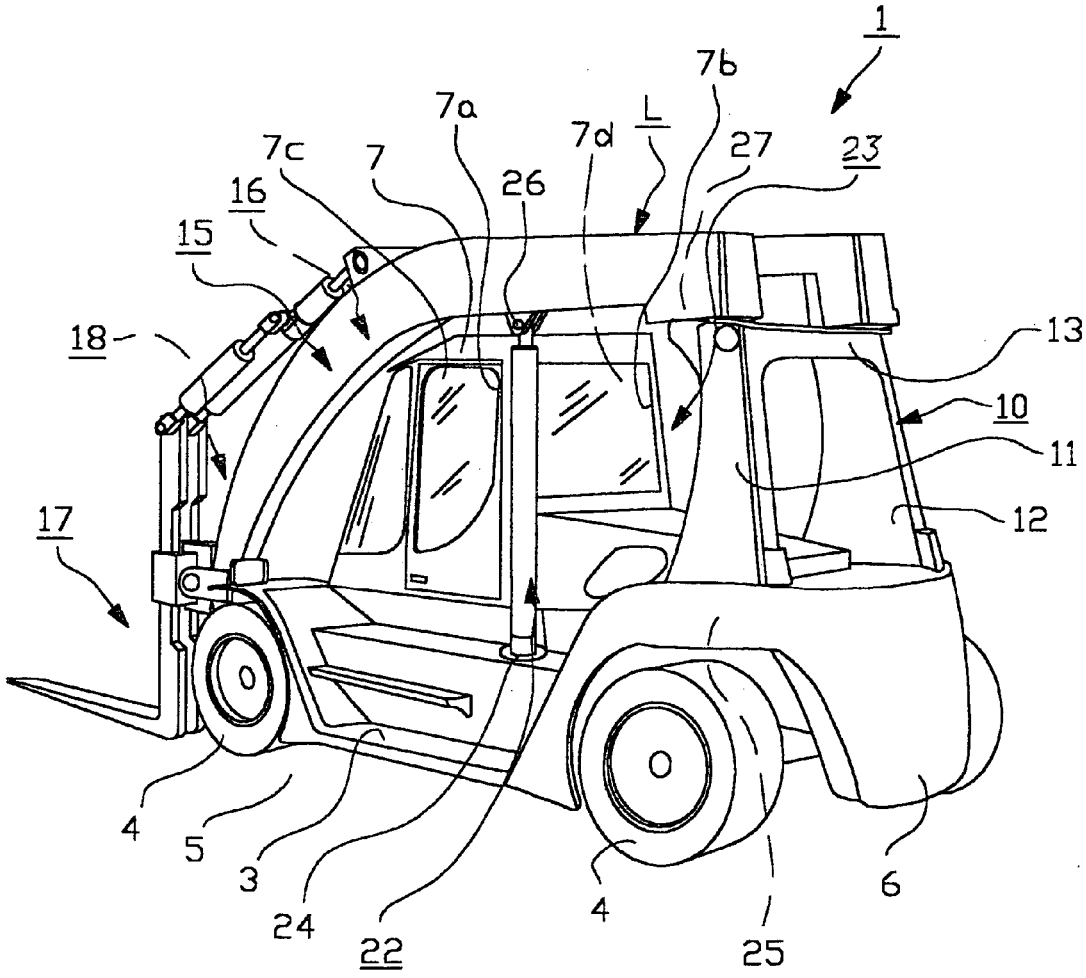

The lift truck 1 illustrated in the drawings is a counterweight lift truck with a driving compartment 2. The lift truck 1 comprises a chassis 3 with e.g. four or six driving wheels 4 for driving on a ground 5. Rear portions 3*a* of the chassis 3 has a driving motor (not shown) for operating the lift truck 1 on the ground 5 and for operating its various control means. The rear portions 3*a* of the chassis 3 also includes the counterweight 6 of the lift truck 1 and the driving compartment 2 is situated in front of said rear portions 3*a*. The driving compartment 2 preferably includes an operator's cabin 7 with a seat 8 which is directed or can be directed forwards towards front portions 3*b* of the chassis 3. When the operator is sitting in the driving compartment 2, he must be able to drive the lift truck 1 and operate a lifting device 9 provided thereon. Thereby, the driver/operator shall have the best possible field of view in forward direction.

The lifting device 9 is adapted to lift goods and is provided on the rear portions 3*a* of the chassis 3 through a retaining device 10. Said device comprises e.g. two upwardly directed posts 11, 12 which in level with the roof of the operator's cabin 7 or somewhat above said roof are connected to each other by a substantially horizontally directed connecting member 13. The connecting member 13 has in turn a centrally provided bracket 14 which is directed upwards and which preferably is centered with a geometric centre line CL passing centrally along the chassis 3.

The posts 11, 12 are preferably provided on opposite sides of the rear portions 3*a* of the chassis 3 in order to give the operator a large field of view SB in backwards direction. The posts 11, 12 are preferably inclined in backwards/outwards direction relative to the centre line CL and they can define substantially the same angle $\gamma$ between them as the field of view SB between said posts.

The lifting device 9 has two lifting arms 15, 16 (jibs) which have substantially straight rear portions 15*a*, 16*a* and arcuate, downwardly directed front portions 15*b*, 16*b*. When the lifting device 9 is set in lower positions L (see FIG. 1), the rear portions 15*a*, 16*a* of the lifting arms 15, 16 are directed substantially horizontally and are found behind or substantially behind a geometric vertical plane VP2 extending through the driving compartment 2 and in transverse direction relative to the centre line CL. The vertical plane VP2 is preferably extending at 90° or substantially 90° relative to the centre line CL. The lifting arms 15, 16 extend in forward direction beyond said vertical plane VP2 and—seen from above towards the lift truck 1—on opposite sides of the driving compartment 2. At least when the lifting device 9 is set in said lower positions L, the lifting arms 15, 16 extend horizontally or substantially horizontally and front portions 15*b*, 16*b* thereof are situated in front of said vertical plane VP2. The front portions 15*b*, 16*b* are in said lower positions of the lifting arms 15, 16 directed preferably forward/downwards such that lower parts 15*c*, 16*c* of the front portions 15*b*, 16*b* can be brought to positions in front of front portions 3*b* of the chassis 3. Lifting means 17, 18 are provided on said lower parts 15*c*, 16*c* and adapted to cooperate with goods for fetching, lifting and delivery. The lifting means 17, 18 can be designed as lift forks.

The lifting arms 15, 16 are provided on the retaining device by means of joints 19 20. Each such joint 19 and 20 respectively, is designed as a two-axled joint or similar, allowing the respective lifting arm 15, 16 to be pivoted in two, preferably perpendicular planes, namely in vertical planes VP15 and VP16 respectively, and horizontal planes HP15 and HP16 respectively (see FIG. 4).

The joints 19, 20 are preferably provided behind the vertical plane VP2 and they are preferably provided at a distance from each other which, seen from above towards the lift truck 1, is only somewhat less than the width B of the chassis 3. Each joint 19 and 20 respectively, may e.g. comprise a fork like bearing member 19*a* and 20*a* respectively, or similar, having a horizontal through shaft 19*b* and 20*b* respectively, on which the rear portions 15*a* and 16*a* respectively, of the lifting arms 15 and 16 respectively, are journalled such that they can pivot in said vertical planes VP15 and VP16 respectively, about a horizontal or substantially horizontal geometric line 21 which may be common to both joints 19, 20. Furthermore, each joint 19 and 20 respectively, may comprise a vertically directed shaft 19*c* and 20*c* respectively, through which the fork like bearing member 19*a* and 20*a* respectively, is journalled on the connecting member 13 such that said bearing member can be pivoted about an at least in certain positions vertical geometric line 19*d* and 20*d* respectively, whereby the lifting arms 15, 16 can be pivoted in said horizontal planes HP15 and HP16 respectively. The geometric line 19*d* and 20*d* respectively, preferably intersects the geometric line 21.

Pivoting of the lifting arms 15 and 16 respectively, in the respective vertical plane VP15, VP16 is carried through by means of lifting units 22 and 23 respectively, which e.g. are shaped as standing cylinder/piston-devices. The lifting units 22, 23 are preferably provided behind the vertical plane VP2 and they are down below journalled on the chassis 3 through lower joints 24, 25 and on the lifting arms 15, 16 through upper joints 26, 27. When the lifting device 9 is set in its lower position L, the lifting units 22, 23 are preferably vertically or substantially vertically directed and they are located preferably obliquely behind rear edge posts 7*a*, 7*b* of the operator's cabin 7 such that they do not conceal the field of view of the driver/operator when he or she looks out through the side windows 7*c*, 7*d* of the operators cabin 7.

Said lower and upper joints 24–27 are designed such that they permit the movements between the lifting units 22, 23 and the chassis 3 on one hand and the lifting units 22, 23 and the lifting arms 15, 16 on the other hand, which are required for being able to pivot the lifting arms 15, 16 in said different planes relative to the chassis 3 and to each other. Said joints 24–27 may e.g. permit movements in general and be designed as ball joints.

Figure 2:
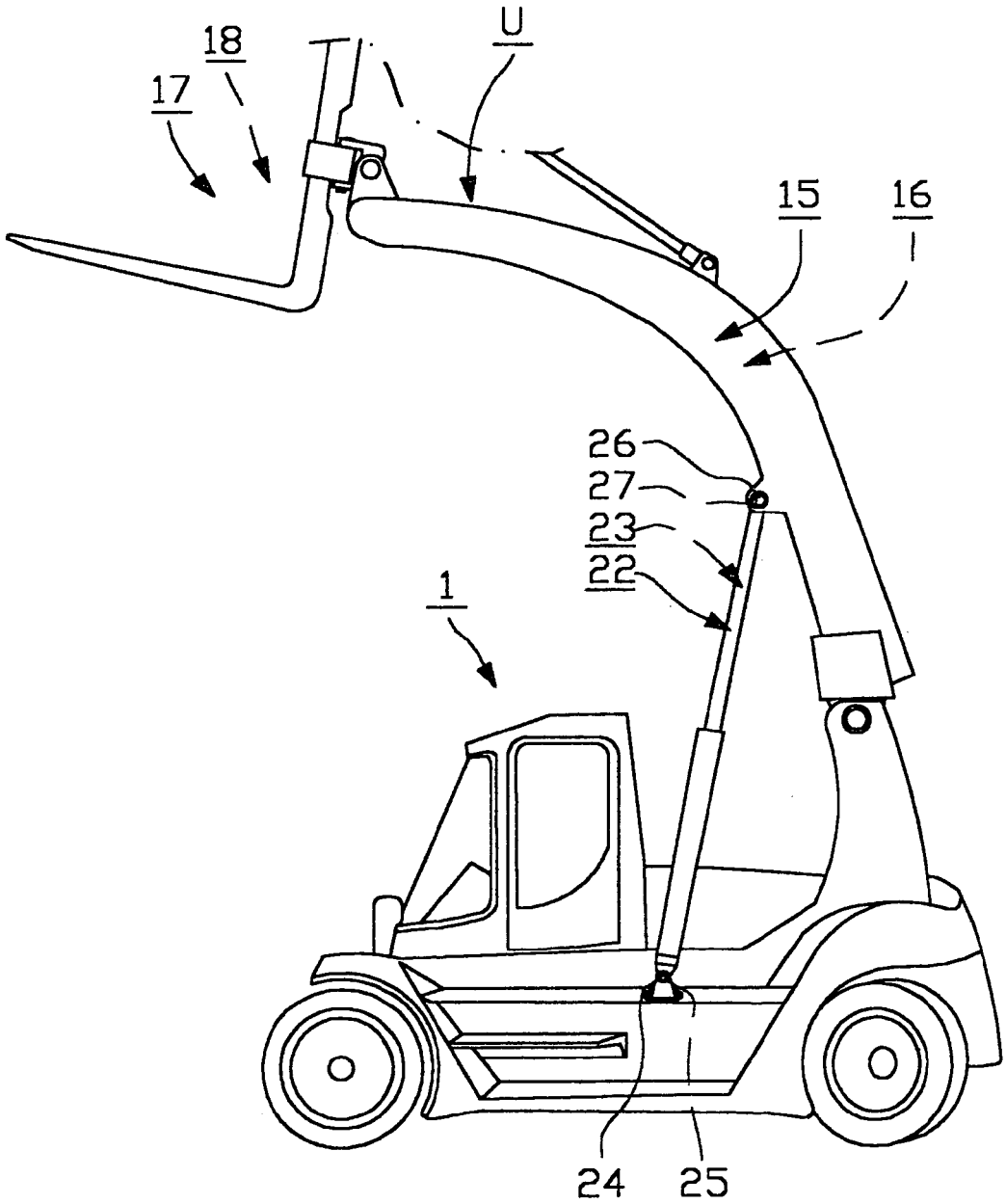
FIG. 2 is a side view of the lift truck of FIG. 1 with the lifting device located in an upper position.
Figure 3:
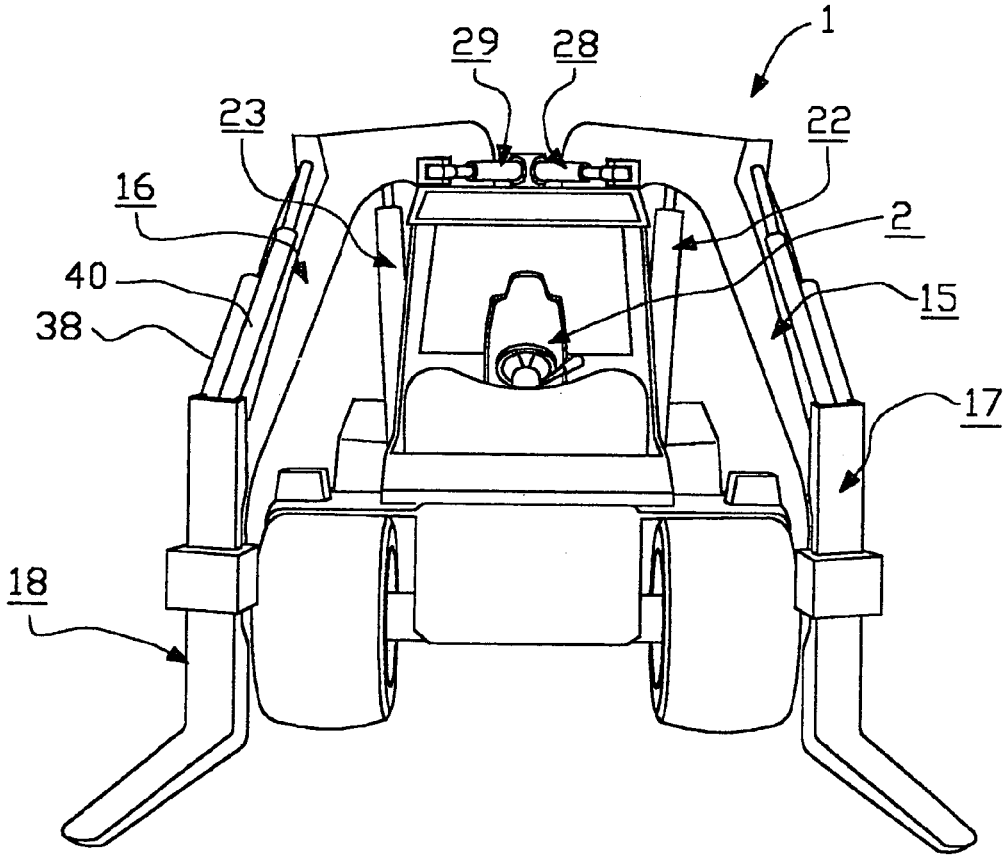
FIG. 3 is a front view of the lift truck of FIG. 1 with lifting arms provided in outwardly pivoted positions relative to each other.

The lifting units 22, 23 are provided to pivot the lifting arms 15, 16 in said vertical planes VP15, VP16 between said lower position L of the lifting device 9 and an upper position U thereof (see FIG. 2). Said lifting units 22, 23 can be operated or controlled to pivot the lifting arms 15, 16 simultaneously and in parallel with each other, but it is also possible to temporarily operate or control one of the lifting arms 15 or 16 to pivot individually relative to the other, e.g. for setting the lifting means 17, 18 at different heights if one fetches goods standing on a sloping ground or places goods on sloping ground.

Pivoting of the lifting arms 15, 16 in horizontal planes HP15, HP16 is carried through by means of pivoting devices 28, 29, e.g. cylinder/piston-devices which at the back are mounted on the bracket 14 through rear joints 30, 31 and at the front through front joints 32, 33 at the lifting arms 15, 16 in front of the joint 19, 20. The rear and front or fore joints 30–33 are designed such that they permit the movements between the bracket 14 and the lifting arms 15, 16 which are necessary for pivoting the lifting arms 15, 16 in said different planes relative to the chassis 3 and to each other. The rear and front joints 30–33 may e.g. permit movements in general and be designed as ball joints.

Figure 5:
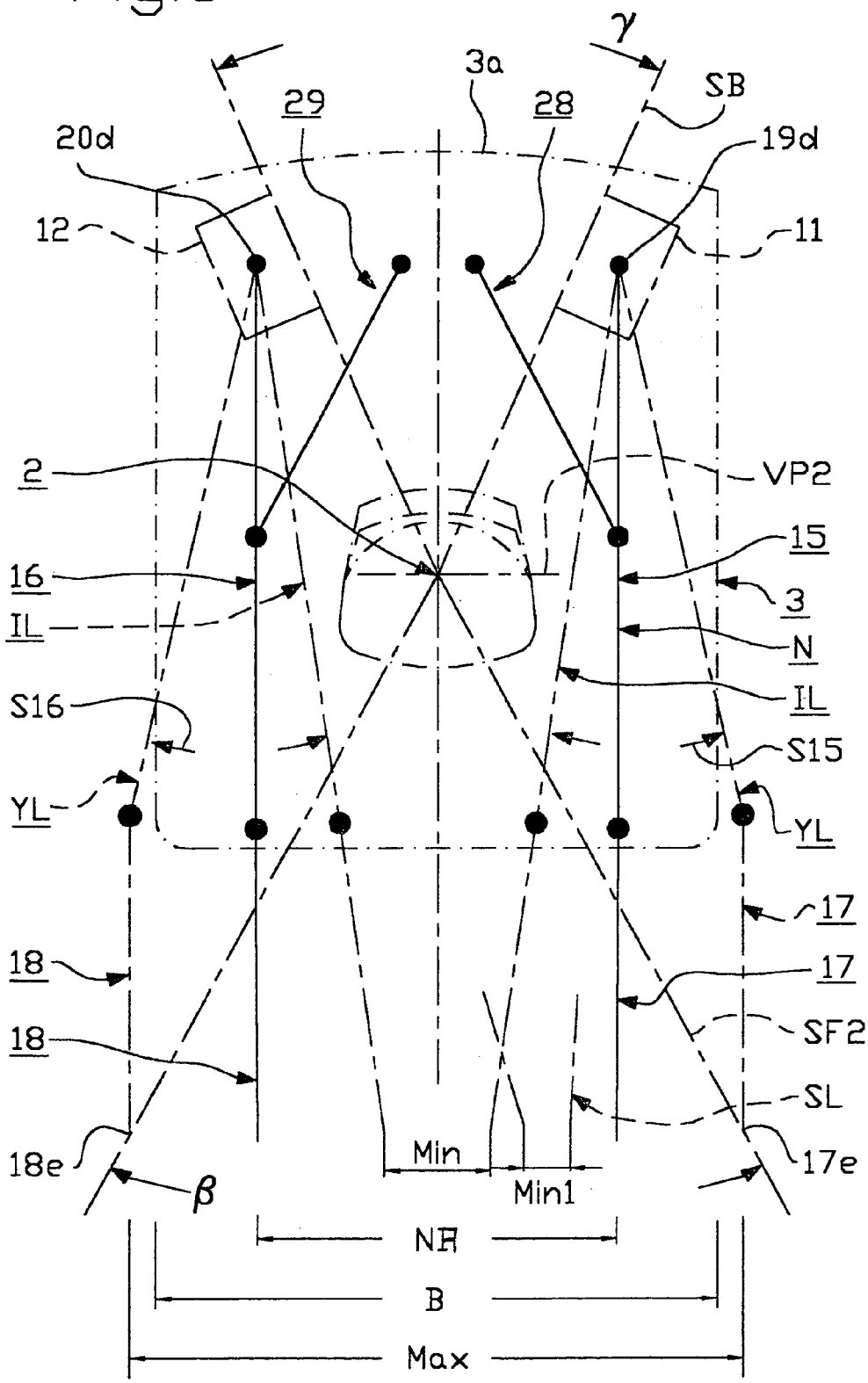
FIG. 5 is a schematic plan view of the lift truck of FIG. 4 with lifting arms forming part thereof in different positions.

In FIG. 5, examples are given of different positions within which and to which the lifting arms 15, 16 can be pivoted about said vertical geometric lines 19*d*, 20*d* in horizontal planes by means of the pivoting devices 28, 29. Thus, the lifting arms 15, 16 can be set in such positions N, which can be intermediate positions, in which they are directed essentially in parallel with the longitudinal centre line CL of the lift truck 1 or in which they converge somewhat. In these positions N in which the lifting arms 15, 16 are shown with solid lines, the distance NA between said arms and the lifting means 17, 18 provided thereon may be less than the width B of the lift truck 1. The lifting arms 15, 16 can be set in said intermediate positions N e.g. when the lift truck 1 is driven without goods and the driver thereby has a sufficiently good view in forward direction for driving the lift truck 1.

In certain cases, e.g. when smaller goods shall be fetched or if you need to reach into narrow spaces of if one shall insert the lifting means 17, 18 into paper rolls or similar, the lifting arms 15, 16 can be pivoted from said intermediate positions N in inwards direction towards each other to inner positions IL—shown with broken lines in FIG. 5—such that the least distance Min between their lifting means 17, 18 will be substantially less than the width B of the lift truck 1. In other cases, e.g. if the driver/operator needs a completely free view within a large area in forward direction and/or if large or long goods shall be fetched, the lifting arms 15, 16 can be pivoted outwards from each other to outer positions YL—illustrated with broken lines in FIG. 5—such that the greatest distance Max between them or their lifting means 17, 18 will be greater or substantially greater than the width B of the lift truck 1.

As is apparent from FIG. 1, the lifting arms 15, 16 can be set in different symmetrical positions relative to the centre line CL within their pivoting areas S15, S16, i.e. at the same distance between the lifting means 17, 18 and the centre line CL. It may however also be possible to set the lifting arms 15, 16 such that their lifting means 17, 18 are situated in asymmetrical positions SL relative to the centre line CL. An example of such positions SL, shown on the right hand side of FIG. 5, is that the lifting arms 15, 16 are set such that their lifting means 17, 18 are found on the same side of the centre line CL and e.g. with a small mutual distance, Min 1.

The pivoting devices 28, 29 can be operated or controlled to pivot the lifting arms 15, 16 simultaneously and symmetrically relative to the centre line CL. The pivoting devices 28, 29 may however also be individually operated or controlled in order to bring each lifting arm 15, 16 to perform an individual pivoting movement for setting the lifting arms 15, 16 in said asymmetrical positions SL.

The front portions 15*b*, 16*b* of the lifting arms 15, 16 and/or the lifting means 17, 18 provided thereon are preferably inclined in a forward/outwards direction relative to said centre line CL such that they define substantially the same angle β between them as a field of view SF2 for the driver/operator in forward direction, preferably when the lifting arms 15, 16 are situated in such intermediate positions N relative to each other in which they are directed in parallel or substantially in parallel with said centre line CL.

The rear joints 30, 31 of the pivoting devices 28, 29 are preferably centered or substantially centered with the horizontal or substantially horizontal geometric line 21 about which the lifting arms 15, 16 are pivotable. The rear joints 30, 31 may however be located further on on the chassis 3, but they are preferably provided behind the vertical plane VP2 through the driving compartment 2.

The front joints 32, 33 of the pivoting devices 28, 29, through which said pivoting devices 28, 29 are articulately mounted on the lifting arms 15, 16, are preferably provided behind the vertical plane VP2, but may be located further on at said vertical plane VP2 or possibly somewhat in front of said vertical plane.

With the arrangement defined above of the lifting arms 15, 16 and their lifting means 17, 18, the operator gets a field of view in forward direction which is free between the lifting arms 15, 16 and the lifting means 17, 18 and which can be made as large as 120° by setting the lifting arms 15, 16 in their outer positions YL. Because of the location of the posts 11, 12 and their inclination, the operator gets an advantageous free field of view SB in backwards direction, and because the lifting units 22, 23 are located obliquely behind the operator's cabin 7, the operator gets an advantageous free field of view also to the sides.

Figure 4:
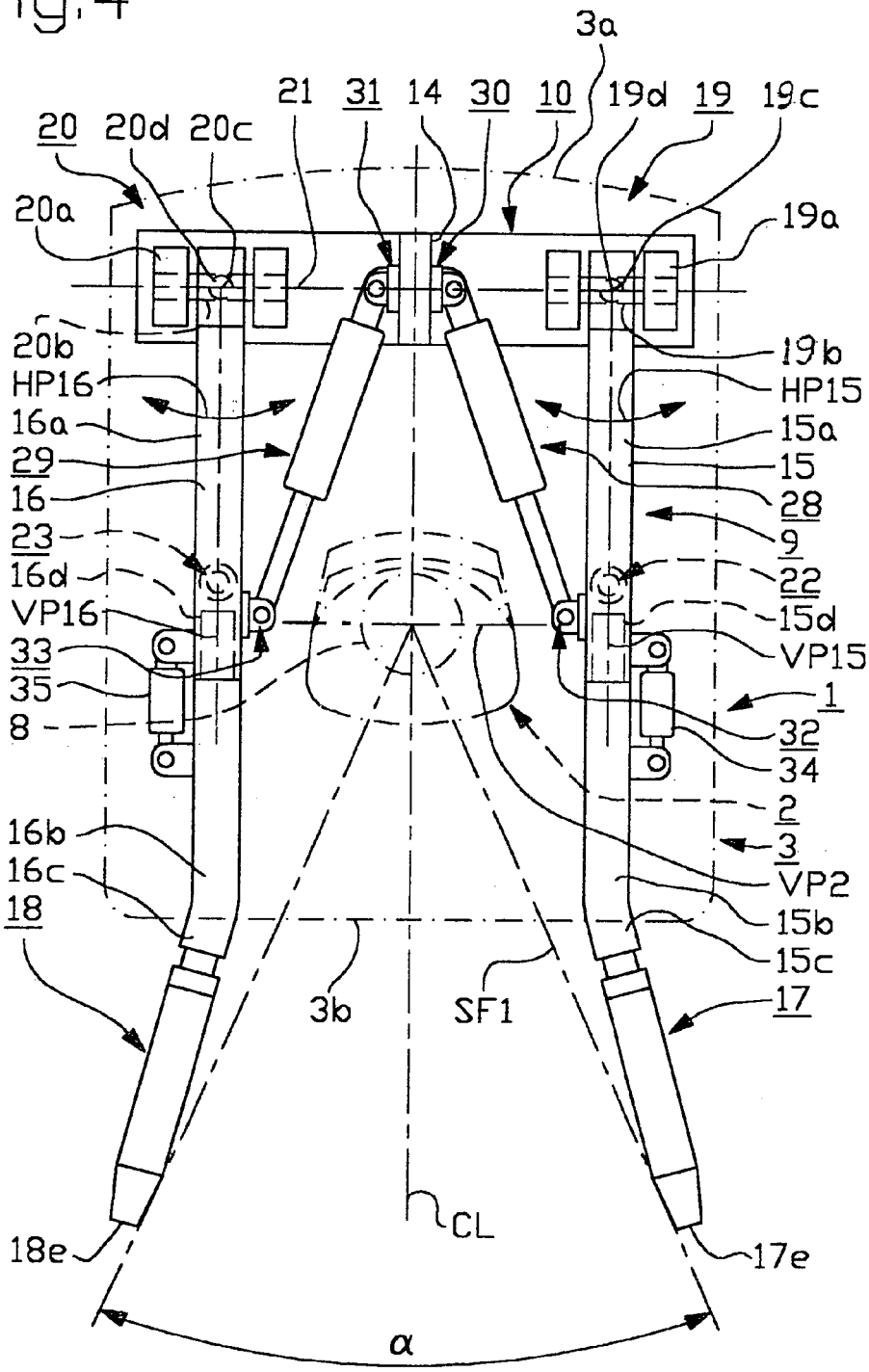
FIG. 4 is a schematic plan view of the lift truck of FIG. 1.

The length of the lifting arms 15, 16 may be varied by giving them a telescopic structure. Such a structure is shown in FIG. 4 and it may consist of that the front portions 15*b* and 16*b* respectively, of each lifting arm 15 and 16 respectively, at the rear have parts 15*d* and 16*d* respectively, which displaceably engage the rear portions 15*a* and 16*a* respectively. In order to change the length of the lifting arms 15, 16 and maintain the length set after the change, there may be power units 34 and 35 respectively, e.g. cylinder/piston-devices, which at the back are mounted on the respective rear portion 15*a*, 16*a* of the lifting arms 15, 16 and at the front on the respective front portion 15*b*, 16*b*. The power units 34, 35 may be operated or controlled to change the length of both lifting arms 15, 16 to the same extent and simultaneously, but they may also be individually operated or controlled in order to momentarily change the length of only one of the lifting arms 15, 16 or in order to momentarily change the length of one lifting arm more than the length of the other lifting arm. This individualability to operate or control the power units 34, 35 to make one lifting arm longer than the other, can be used e.g. for fetching tilted goods.

Two lifting units 22, 23 are shown in the drawings, but it is eventually possible to use one such or more than two such lifting units for lifting or raising the lifting arms 15, 16 in the vertical planes VP15, VP16. Furthermore, two pivoting devices 28, 29 are shown in the drawings, but it is eventually possible to use one such or more than two such pivoting devices for pivoting the lifting arms 15, 16 in the horizontal planes HP15, HP16.

Figure 6:
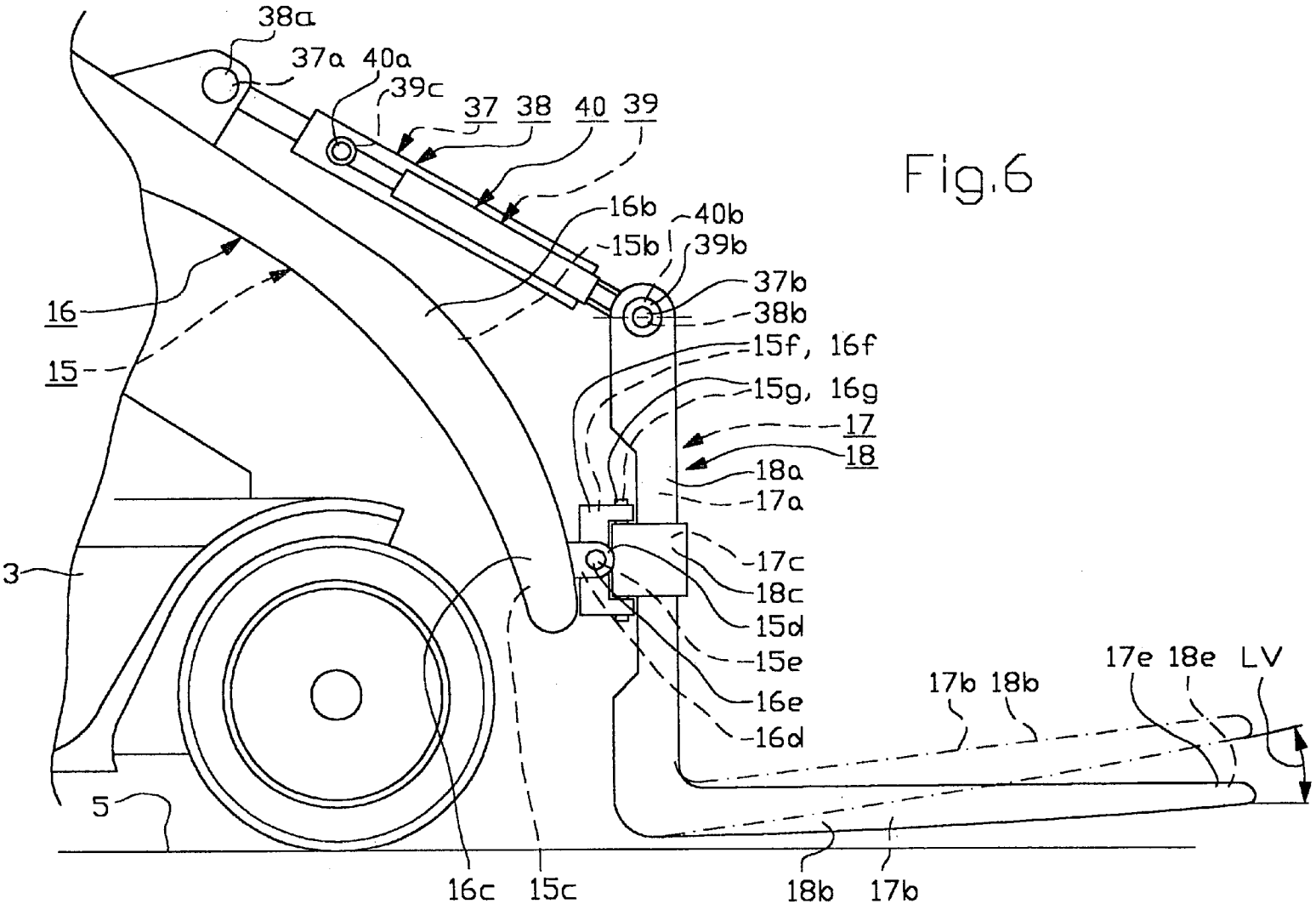
FIG. 6 is a side view of front members of the lift truck of FIG. 1.
Figure 7:
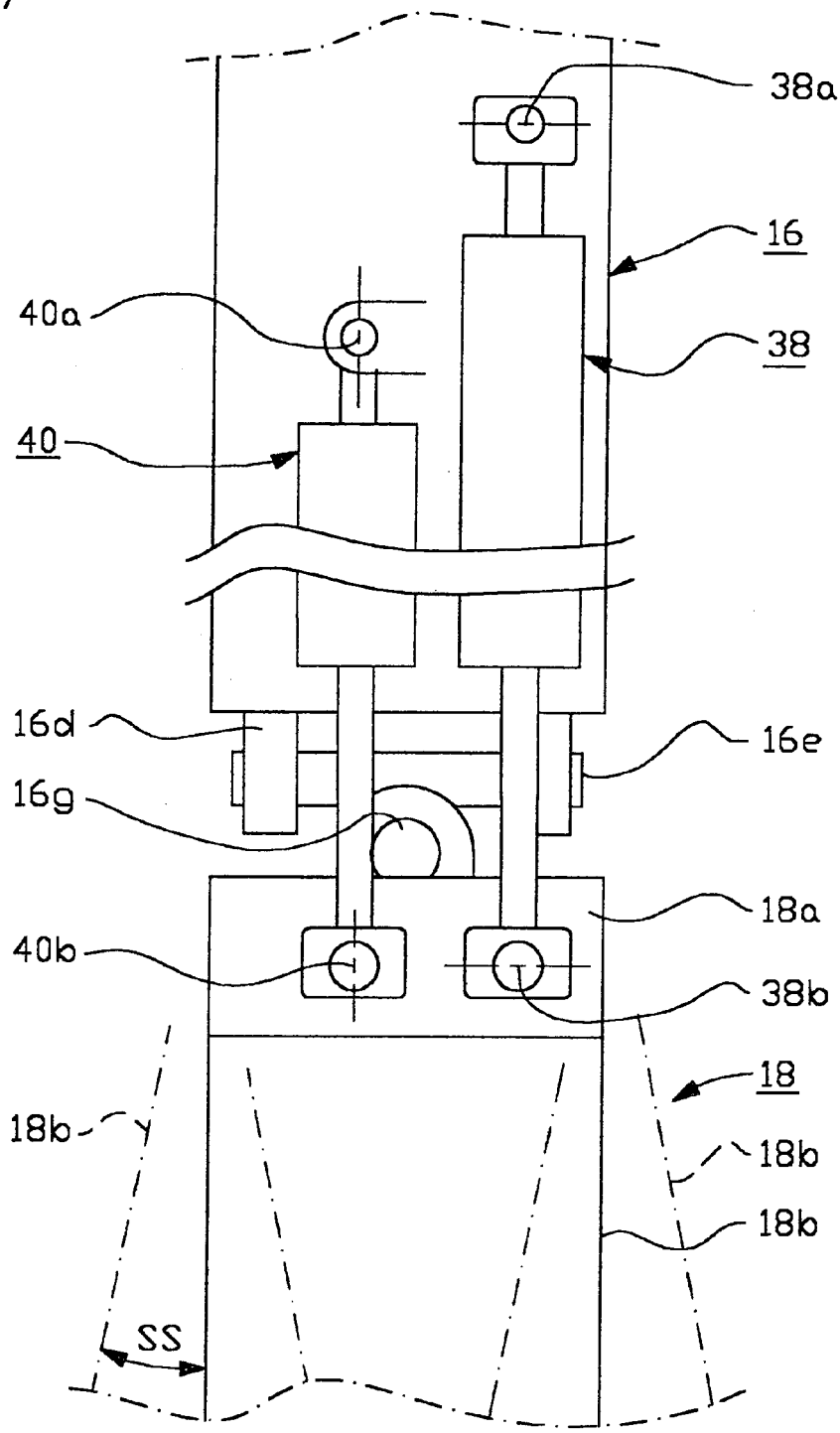
FIG. 7 is a plan view of some of said front members.

As is apparent from FIGS. 6 and 7, each lifting means 17, 18 may consist of a lift fork. Each lift fork may comprise a fork shaft 17*a* and 18*a* respectively, and a fork blade 17*b* and 18*b* respectively. The fork shafts 17*a*, 18*a* are provided on the lower parts 15*c*, 16*c* of the lifting arms 15, 16. For this purpose, each lower part 15*c* and 16*c* respectively, may include flanges 15*d* and 16*d* respectively, in which a horizontal shaft 15*e* and 16*e* respectively, is provided. A U-shaped joint element 15*f* and 16*f* respectively, is provided on said horizontal shaft such that it can pivot or rotate about the shaft. A vertically or substantially vertically directed shaft 15*g* and 16*g* respectively, is provided on the U-shaped joint element 15*f* and 16*f* respectively, and a tubular member 17*c* and 18*c* respectively, is provided on said shaft such that it can pivot or rotate about the shaft. In each tubular member 17*c* and 18*c* respectively, one of the fork shafts 17*a* and 18*a* respectively, is longitudinally displaceably mounted.

A first pivoting unit 37 and 38 respectively, is provided on each lifting arm 15, 16 and adapted for pivoting the lift forks about the horizontal shafts 15*e*, 16*e* and thereby alter the angle of inclination LV between the fork blades 17*b*, 18*b* and the horizontal plane. Each first pivoting unit 37, 38 may be a cylinder/piston-device or similar and is mounted through a joint 37*a*, 38*a* to the lifting arms 15, 16 and through a joint 37*b*, 38*b* to upper parts of the fork shaft 17*a*, 18*a*. The joints 37*a*, 38*a*, 37*b*, 38*b* may permit movements in general and may be designed as ball joints.

Said first pivoting units 37, 38 can be operated or controlled to pivot the lifting means 17, 18 simultaneously and so that their fork blades 17*b*, 18*b* take positions corresponding to each other. The first pivoting units 37, 38 may also be individually operated or controlled to pivot only one of the lifting means 17 or 18 for changing position of only one of the fork blades 17*b* or 18*b* or changing position of the lifting means 17, 18 to various extents in order to bring the fork blades 17*b*, 18*b* into different positions relative to the horizontal plane.

The fork shafts 17*a*, 18*a* can be pivoted about the shafts 15*g* and 16*g* respectively, for setting the fork blades 17*b*, 18*b* in different positions within a pivoting sector SS relative to the centre line CL. The pivoting of the fork shafts 17*a*, 18*a* and thereby, the fork blades 17*b*, 18*b*, is carried through by means of second pivoting units 39, 40 provided beside the first pivoting units 37, 38. The second pivoting units 39, 40 may be cylinder/piston-devices or similar and they are connected to the first pivoting units 37, 38 through joints 39*c*, 40*a* and to the fork shafts 17*a*, 18*a* through joints 39*b*, 40*b*, whereby said joints 39*c*, 40*a*, 39*b*, 40*b* are provided to permit movements in general and thereby, pivoting of the lift forks.

The second pivoting units 39, 40 may be operated or controlled to pivot the lifting means 17, 18 simultaneously and so that their fork blades 17*b*, 18*b* take the same angular positions relative to the centre line CL. The second pivoting units 39, 40 may also be operated or controlled to pivot the lifting means individually for changing position of only one of the lifting means 17 or 18 and thereby, the angular position of only one of the fork blades 17*b* or 18*b*, or pivot the lifting means 17, 18 differently in order to bring the fork blades 17*b*, 18*b* into different angular positions relative to the centre line CL.

Since each lifting means 17 and 18 respectively, is provided on a lifting arm 15 and 16 respectively, instead of on a lifting carriage, such a carriage is not required nor are those vertical beams along which the carriage was movable. This means that many parts and members which previously were found in the field of view of the driver/operator disappear and the construction of the lift truck becomes less complex.

In order to present the best possible field of view to the driver/operator, the lifting arms 15, 16 are preferably provided to permit between them a free or substantially free view for the operator in forward direction when said operator is in the driving compartment 2. The operator's view becomes particularly good if the front portions 15*b*, 16*b* of the lifting arms 15, 16 lack connections or in any case lack connections to each other substantially impairing the view.

The lifting arms 15, 16 are preferably also provided to permit between them a free or substantially free view such that the operator of the lift truck 1 from the driving compartment 2 can see front tips 17*e*, 18*e* of the lifting means 17, 18 which are provided on the front portions 15*b*, 16*b* of the lifting arms 15, 16.

Since the lifting arms 15, 16 lack connections between them, said arms and the retaining device 10 located behind the driving compartment 2 can replace vertical beams located in front of the driving compartment and a lifting carriage provided on said beams.

Preferably, the lifting arms 15, 16 or members located thereon have no connections whatsoever to each other in front of the joints 19, 20, which in many cases is an advantageous embodiment.

The lifting means 17, 18 may instead of lift forks consist of fetching arms (not shown) for fetching certain goods, e.g. bales or rolls. Eventually, a clamping device—e.g. a cylinder/piston-device—can be located between said fetching arms for clamping or gripping bales or rolls therebetween such that they can be lifted. The lifting means 17, 18 may also be an assembly in the form of a lifting assembly for plate like goods or similar.

In the above description it is stated that axes, lines and planes are horizontal or vertical, but these are desired ideal positions which are true when the lift truck 1 stands on horizontal or substantially horizontal ground 5 and which, depending on different constructions or other factors in reality can deviate up to a few percent and eventually up to 10 percent from said desired ideal positions.

The invention is not limited to the embodiment described above and illustrated in the drawings, but may vary within the scope of the subsequent claims regarding the number, location and function of the various parts and members. It can e.g. be mentioned that the lifting arms 15, 16 may have another shape than shown and they may define or include other types of lifting means for goods than those shown. The joints 19, 20 may be constructed other wise than shown and described and yet provide the desired function. It should finally be mentioned that the invention is applicable on other lift trucks than counterweight trucks.

What is claimed is:

1. A lift truck (1) comprising:

a chassis (3), said chassis (3) including a driving compartment (2), said chassis having front portions (3*b*);

a lifting device (9) for lifting goods, said lifting device (9) including two lifting arms (15, 16), each of said lifting arms (15, 16) having a rear portion (15*a* or 16*a*) provided on the chassis (3) behind said driving compartment (2), each of said lifting arms (15, 16) further including a front portion (15*b* or 16*b*);

a plurality of lifting members (17, 18), one of said lifting members (17, 18) is provided on one of said front portions (15*b*, 16*b*) of said lifting arms (15, 16), another one of said lifting members (17, 18) is provided on another one of said front portions (15*b*, 16*b*) of said lifting arms (15, 16), said lifting members (17, 18) being adapted for fetching and delivering goods, each of said lifting members (17 or 18) including a front tip (17*e* or 18*e*);

a plurality of joints (19, 20), one of said joints (19, 20) operatively connected to one of said rear portions (15*a*, 16*a*) and said chassis (3) to permit pivoting of said one of said lifting arms (15, 16), another one of said joints (19, 20) operatively connected to said another one of said rear portions (15*a*, 16*a*) and said chassis (3) to permit pivoting of another one of said lifting arms (15, 16);

a plurality of lifting units (22, 23), said one of said lifting units (22, 23) operatively connected to one of said lifting arms (15, 16) to pivot said one of said lifting arms (15, 16) in one of a plurality of vertical planes (VP15, VP16), another one of said lifting units (22, 23) operatively connected to another one of said lifting arms (15, 16) to pivot said another one of said lifting arms (15, 16) in another one of the vertical planes (VP15, VP16), said lifting units (22, 23) pivoting said lifting arms (15, 16) in their respective vertical planes (VP15, VP16) for moving goods in vertical directions;

a plurality of pivoting devices (28, 29), one of said pivoting devices (28, 29) is operatively connected to one of said lifting arms (15, 16) to pivot said one of said lifting arms (15, 16) in one of a plurality of horizontal planes (HP15, HP16), another one of said pivoting devices (28, 29) is operatively connected to said another one of said lifting arms (15, 16) to pivot said another one of said lifting arms (15, 16) in another one of said horizontal planes (HP15, HP16), said pivoting devices (28, 29) pivoting said lifting arms (15, 16) in their respective horizontal planes (HP15, HP16) for changing the distance (NA) and/or the angle ($\alpha$) between said front portions (15*b*, 16*b*) of said lifting arms (15, 16) thereof or for changing the distance (NA) and/or the angle ($\alpha$) between said lifting members (17, 18); and characterized in that said pivoting devices (28, 29) and said joints (19, 20) permit pivoting of said lifting arms (15, 16) between inner positions (IL) in which the distance (Min) between said front portions (15*b*, 16*b*) of said lifting arms (15, 16) or between said front tips (17*e*, 18*e*) is less than the width of said front portions (3*b*) of said chassis (3), and outer positions (YL) in which the distance (Max) between said front portions (15*b*, 16*b*) of said lifting arms (15, 16) or between said front tips (17*e*, 18*e*) is greater than the width (B) of said front portions (3*b*) of the chassis (3).

2. The lift truck (1) according to claim 1, characterized in that said front portions (15*b*, 16*b*) of said lifting arms (15, 16) in front of said driving compartment (2) lack any connections between them which would prohibit a free or substantially free view for the driver/operator in the forward direction.

3. The lift truck (1) according to claim 1, characterized in that said front portions (15*b*, 16*b*) of said lifting arms (15, 16) are provided to permit between them a free or substantially free view such that the driver/operator of the lift truck (1) from said driving compartment (2) can see said front tips (17*e*, 18*e*) of said lifting members (17, 18).

4. The lift truck (1) according to claim 1, characterized in that said lifting arms (15, 16) are provided to permit that said front portions (15*b*, 16*b*) of said lifting arms (15, 16) are visible from the driving compartment (2) when said lifting arms (15, 16) are set in the inner positions (IL), the outer positions (YL) and positions therebetween.

5. The lift truck (1) according to claim 1, characterized in that said lifting arms (15, 16) are provided to permit that said front tips (17*e*, 18*e*) of said lifting members (17, 18) located on said front portions (15*b*, 16*b*) of said lifting arms (15, 16) are visible from the driving compartment (2) when said lifting arms (15, 16) are set in the inner positions (IL), the outer positions (YL) and positions therebetween.

6. The lift truck (1) according to claim 1, characterized in that, when said lifting arms (15, 16) are in the inner positions (IL), said lifting arms (15, 16) have a minimum distance (Min) between said front portions (15*b*, 16*b*) of said lifting arms (15, 16) which is substantially less than a maximum distance (Max) between said front portions (15*b*, 16*b*) of said lifting arms (15, 16).

7. The lift truck (1) according to claim 1, characterized in that, when said lifting arms (15, 16) are in the inner positions (IL), said lifting arms (15, 16) have a minimum distance (Min) between said front tips (17*e*, 18*e*) which is substantially less than a maximum distance (Max) between said front tips (17*e*, 18*e*).

8. The lift truck (1) according to claim 1, characterized in that each of said lifting arms (15 or 16) is selectively positioned in an intermediate position (N) between said inner and outer positions (IL, YL), wherein said lifting arms (15, 16) are directed in parallel or substantially in parallel with each other and in parallel or substantially in parallel with a geometric centre line (CL) extending centrally along the chassis (3), when said lifting arms (15, 16) are in the intermediate positions (N).

9. The lift truck (1) according to claim 1, characterized in that said lifting arms (15, 16) are provided on opposite sides of a geometric centre line (CL) extending centrally along said chassis (3) and that said pivoting devices (28, 29, respectively) are operated to pivot their respective lifting arms (15, 16 respectively) simultaneously and symmetrically relative to said centre line (CL) to such positions in relation thereto that they define substantially the same angle therewith.

10. The lift truck (1) according to claim 1, characterized in that said lifting arms (15, 16) are provided on opposite sides of a geometric centre line (CL) extending centrally along the chassis (3) and that said pivoting devices (28, 29 respectively) are operated to pivot their respective lifting arms (15, 16, respectively) simultaneously and asymmetrically relative to the center line (CL) to such positions that they define different angles therewith.

11. The lift truck (1) according to claim 10, characterized in that the pivoting devices (28, 29 respectively) are operated or controlled to pivot their respective lifting arms (15, 16 respectively) to such positions that said front portions (15*b*, 16*b*) of said lifting arms (15, 16) are located on the same side of the center line (CL) and at a small distance (Min 1) from each other.

12. The lift truck (1) according to claim 10, characterized in that the pivoting devices (28, 29 respectively) are operated or controlled to pivot their respective lifting arms (15, 16 respectively) to such positions that said front tips (17*e*, 18*e*) of said lifting members (17, 18) on said front portions (15*b*, 16*b*) of said lifting arms (15, 16) are located on the same side of the center line (CL) and at a small distance (Min 1) from each other.

13. The lift truck (1) according to claim 1, characterized in that said lifting arms (15, 16) are pivotable in horizontal planes (HP15, HP16) at least when they are set in lower positions in which they extend horizontally or substantially horizontally.

14. The lift truck (1) according to claim 1, including a plurality of rear joints (30, 31), said one of said pivoting devices (28, 29) is articulately mounted on said chassis (3) through one of said rear joints (30, 31), said another one of said pivoting devices (28, 29) is articulately mounted on said chassis (3) through another one of said rear joints (30, 31), said rear joints (30, 31) being located behind a vertical plane (VP2) which extends through the driving compartment (2) and in a transverse direction relative to a geometric center line (CL) passing centrally through the chassis (3), a plurality of front joints (32, 33), said one of said pivoting devices (28, 29) is articulately mounted on said one of said lifting arms (15, 16) through one of said front joints (32, 33), said another one of said pivoting devices (28, 29) is articulately mounted on said another one of said lifting arms (15, 16) through another one of said front joints (32, 33), said front joints (32, 33) being located behind said vertical plane (VP2), at said vertical plane or at a small distance in front of said plane.

15. The lift truck (1) according to claim 1, including a plurality of rear joints (30, 31), said one of said pivoting devices (28, 29) is articulately mounted on said chassis (3) through one of said rear joints (30, 31), said another one of said pivoting devices (28, 29) is articulately mounted on said chassis (3) through another one of said rear joints (30, 31), a plurality of front joints (32, 33), said one of said pivoting devices (28, 29) is articulately mounted on said one of said lifting arms (15, 16) through one of said front joints (32, 33), said another one of said pivoting devices (28, 29) is articulately mounted on said another one of said lifting arms (15, 16) through another one of said front joints (32, 33), characterized in that said rear and front joints (30, 31, 32, 33) are provided to permit movements in general.

16. The lift truck (1) according to claim 1, characterized in that said one of said lifting arms (15, 16) is pivotable in said one of said horizontal planes (HP15, HP16) about one of a plurality of geometric lines (19*d*, 20*d*) intersecting a geometric line (21) about which said one of said lifting arms (15, 16) is pivotable in said one of said vertical planes (VP15, VP16), said another one of said lifting arms (15, 16) is pivotable in said another one of said horizontal planes (HP15, HP16) about another one of the geometric lines (19*d*, 20*d*) intersecting the geometric line (21) about which said another one of said lifting arms (15, 16) is pivotable in said another one of said vertical planes (VP15, VP16).

17. The lift truck (1) according to claim 1, including a plurality of rear joints (30, 31), characterized in that one of said pivoting devices (28, 29) is articulately mounted on said chassis (3) through one of said rear joints (30, 31), another one of said pivoting devices (28, 29) is articulately mounted on said chassis (3) through another one of said rear joints (30, 31), said rear joints (30, 31) being centered or substantially centered with a horizontal or substantially horizontal geometric line (21) about which said lifting arms (15, 16) are pivotable.

18. The lift truck (1) according to claim 17, characterized in that said rear joints (30, 31) are located between at least two of said joints (19, 20), which are operatively connected to said rear portions (15*a*, 16*a*), permitting pivoting of the lifting arms (15, 16) in vertical and horizontal planes (VP15, VP16; HP15, HP16).

19. The lift truck (1) according to claim 1, wherein said chassis has a plurality of rear portions (3*a*), characterized in that said pivoting devices (28, 29) are provided on said rear portions (3*a*) of said chassis (3) through a retaining device (10) on which said joints (19, 20) for the lifting arms (15, 16) are also provided.

20. The lift truck (1) according to claim 1, including a retaining device (10) for holding said joints (19, 20) at said chassis (3), said retaining device (10) comprises two upwardly directed posts (11, 12) and a connecting member (13) connecting said posts (11, 12) to each other, said chassis including rear portions (3*a*), wherein said posts (11, 12) are provided on opposite sides of said rear portions (3*a*) of said chassis (3) such that a field of view (SB) is defined therebetween in a direction backwards from said driving compartment (2) and that upper parts of said connecting member (13) are located substantially in level with the roof of an operator's cabin (7) provided on the chassis (3).

21. The lift truck (1) according to claim 20, characterized in that said posts (11, 12) are inclined in a backwards/outwards direction relative to a geometric centre line (CL) passing or extending centrally along the chassis (3) and that said posts (11, 12) are inclined relative to said centre line (CL) such that they define the same angle ($\gamma$) between them, which limits the field of view (SB) between said posts (11, 12).

22. The lift truck (1) according to claim 21, characterized in that said one of said joints (19, 20) for said one of said lifting arms (15, 16) comprises a fork like bearing member (19*a* or 20*a*) having a horizontal or substantially horizontal shaft (19*b* or 20*b*) on which said one of said lifting arms (15, 16) is mounted and which permits pivoting thereof in said one of said vertical planes (VP15, VP16), said another one of said joints (19, 20) for said another one of said lifting arms (15, 16) comprises another fork like bearing member (19*a* or 20*b*) having a horizontal or substantially horizontal shaft (19*b* or 20*b*) on which said another one of said lifting arms (15, 16) is mounted and which permits pivoting thereof in another one of said vertical planes (VP15, VP16), said one of said joints (19, 20) comprising a substantially vertical shaft (19*c*, 20*c*) that journals said fork like bearing member (19*a*, or 20*a*) on said chassis (3) such that said one of said lifting arms (15, 16) can be pivoted in said one of said horizontal planes (HP15, HP16), said another one of said joints (19, 20) comprising another substantially vertical shaft (19*c*, 20*c*) that journals said another fork like bearing member (19*a*, or 20*a*) on said chassis (3) such that said another one of said lifting arms (15, 16) can be pivoted in said another one of said horizontal planes (HP15, HP16).

23. The lift truck (1) according to claim 1, characterized in that said one of said joints (19, 20) for said one of said lifting arms (15, 16) comprises a fork like bearing member (19*a* or 20*a*) having a horizontal or substantially horizontal shaft (19*b* or 20*b*) on which said one of said lifting arms (15, 16) is mounted and which permits pivoting thereof in said one of said vertical planes (VP15, VP16), said another one of said joints (19, 20) for said another one of said lifting arms (15, 16) comprises another fork like bearing member (19*a* or 20*b*) having a horizontal or substantially horizontal shaft (19*b* or 20*b*) on which said another one of said lifting arms (15, 16) is mounted and which permits pivoting thereof in another one of said vertical planes (VP15, VP16), a retaining device (10) provided on said chassis (3), said one of said joints (19, 20) comprising a substantially vertical shaft (19*c*, 20*c*) that journals said fork like bearing member (19*a*, or 20*a*) on said chassis (3) such that said one of said lifting arms (15, 16) can be pivoted in said one of said horizontal planes (HP15, HP16), said another one of said joints (19, 20) comprising another substantially vertical shaft (19*c*, 20*c*) that journals said another fork like bearing member (19*a*, or 20*a*) on retaining device (10) such that said another one of said lifting arms (15, 16) can be pivoted in said another one of said horizontal planes (HP15, HP16).

24. The lift truck (1) according to claim 1, characterized in that said lifting units (22, 23) for pivoting the lifting arms (15, 16) in vertical planes (VP15, VP16) are located between the chassis (3) and the lifting arms (15, 16) behind a vertical plane (VP2) extending through the driving compartment (2) and in transverse direction relative to a geometric centre line (CL) which extends centrally along the chassis (3).

25. The lift truck (1) according to claim 1, including a plurality of lower and upper joints (24, 25, 26, 27) characterized in that said one of said lifting units (22, 23) for pivoting said one of said lifting arms (15, 16) in said one of said vertical planes (VP15, VP16) is articulately connected to said chassis (3) and said one of said lifting arms (15, 16) through a said lower joint (24) and a said upper joint (26) permitting movements in general, said another one of said lifting units (22, 23) for pivoting said another one of said lifting arms (15, 16) in said another one of said vertical planes (VP15, VP16) is articulately connected to said chassis (3) and said another one of said lifting arms (15, 16) through another said lower joint (25) and another said upper joint (27) permitting movements in general.

26. The lift truck (1) according to claim 1, characterized in that said lifting units (22, 23 respectively) for pivoting their respective lifting arms (15, 16 respectively) in their respective vertical planes (VP15, VP16 respectively) are controlled to pivot the lifting arms (15, 16) simultaneously and symmetrically relative to a horizontal plane and that each of said lifting units (22 and 23) is controlled to also bring its respective lifting arm (15 or 16) to perform an individual pivoting movement in its respective vertical plane (VP15 or VP16) for setting the lifting arms (15, 16) in different height positions relative to each other.

27. The lift truck (1) according to claim 1, including a cabin (7) for an operator in which the driving compartment (2) is provided, said cabin (7) including a plurality of rear edge posts (7*a*, 7*b*) characterized in that said one of said lifting units (22, 23) is located obliquely outside and behind one of said rear edge posts (7*a* or 7*b*), and said another one of said lifting units (22, 23) is located obliquely outside and behind another one of said rear edge posts (7*a* or 7*b*).

28. The lift truck (1) according to claim 1, characterized in that each of said front portions (15*b*, 16*b*) of said lifting arms (15, 16) are inclined in a forward/outwards direction relative to a geometric centre line (CL) extending centrally along the chassis (3) and that said front portions (15*b*, 16*b*) of said lifting arms (15, 16) are inclined such that they define substantially the same angle (β) between them as a field of view (SF1) between said front portions (15*b*, 16*b*), when the lifting arms (15, 16) are situated in such intermediate positions (N) relative to each other in which the lifting arms (15, 16) are directed in parallel or substantially in parallel with said centre line (CL).

29. The lift truck according to claim 1, characterized in that each of said lifting arms (15, 16) comprises a rear portion (15*a* or 16*a*), each of said rear portions (15*a*, 16*a* respectively) of said lifting arms (15, 16 respectively) extend horizontal or substantially horizontally upon being in a lower position (L), each of said front portions (15*b*, 16*b* respectively) of said lifting arms (15, 16 respectively) are arcuate and downwardly directed, each of said front portions (15*b*, 16*b* respectively) of said lifting arms (15, 16) includes a lower part (15*c* or 16*c*) that is located in front of said front portions (3*b*) of the chassis (3), when its respective front portion (15C or 16C) is located in a lower position (L).

30. The lift truck (1) according to claim 1, characterized in that each of the lifting arms (15, 16) is telescopic such that its length can be varied, a plurality of power units (34, 35), one of said power units (34, 35) is operatively connected to said one of said lifting arms (15, 16) and provided to change the length of said one of said lifting arms (15, 16) and maintain the length set after the change, another one of said power units (34, 35) is operatively connected to said another one of said lifting arms (15, 16) and provided to change the length of said another one of said lifting arms (15, 16) and maintain the length set after the change.

31. The lift truck (1) according to claim 30, characterized in that said power units (34, 35) are operable to change the length of their respective lifting arms (15, 16) at the same time and to the same extent and that said power units (34, 35) are individually controllable to change the length of only one lifting arm (15 or 16) and not of the other or to change the length of the two lifting arms (15, 16) differently.

32. The lift truck (1) according to claim 1, characterized in that each of said lifting members (17, 18) is in the form of a lift fork provided on its respective front portion (15*b* or 16*b*) of said lifting arms (15, 16).

33. The lift truck (1) according to claim 32, wherein each of said front portions (15*b* or 16*b*) of said lifting arms (15, 16) includes a lower part (15*c* or 16*c*), said one of said lifting members (17, 18) being provided on one of said lower parts (15*c*, 16*c*) of said one of said front portions (15*b* or 16*b*) of said lifting arms (15, 16), said another one of said lifting members (17, 18) being provided on another one of said lower parts (15*c*, 16*c*) of said another one of said front portions (15*b* or 16*b*) of said lifting arms (15, 16).

34. The lift truck (1) according to claim 32, wherein each of said lifting members (17, 18) includes a fork blade (17*b* or 18*b*), a plurality of first pivoting units (37, 38), one of said first pivoting units (37, 38) being provided to pivot said one of said lifting members (17, 18) to such positions relative to said one of said lifting arms (15, 16), another one of said first pivoting units (37, 38) being provided to pivot said another one of said lifting members (17, 18) to such positions relative to said another one of said lifting arms (15, 16) and that each of said fork blades (17*b* or 18*b*) is set in horizontal positions or positions which are inclined relative to said horizontal positions.

35. The lift truck (1) according to claim 34, characterized in that said first pivoting units (37, 38) are operated or controlled to pivot their respective lifting members (17, 18) simultaneously and also such that said fork blades (17*b*, 18*b*) are set in positions corresponding to each other and that said first pivoting units (37, 38) are controlled to pivot their respective lifting members (17, 18) individually for changing position of one of said lifting members (17 or 18) only and thereby the angular position of one fork blade (17*b* or 18*b*) only, or pivot the lifting members (17, 18) differently for locating the fork blades (17*b*, 18*b*) in different positions relative to the horizontal plane.

36. The lift truck according to claim 1, wherein each of said lifting members (17, 18) includes a fork blade (17*b* or 18*b*), a plurality of pivoting units (39, 40) being provided, one of said pivoting units (39, 40) operatively connected to said one of said lifting members (17, 18) to pivot said one of said lifting members (17, 18) to such positions relative to said one of said lifting arms (15, 16) that said fork blade (17*b* or 18*b*) of said one of said lifting members (17, 18) changes its angular position relative to a geometric line (CL) extending centrally through the chassis (3), another one of said pivoting units (39, 40) operatively connected to said another one of said lifting members (17, 18) to pivot said another one of said lifting members (17, 18) to such positions relative to said another one of said lifting arms (15, 16) that said fork blade (17*b* or 18*b*) of said another one of said lifting members (17, 18) changes its angular position relative to a geometric line (CL) extending centrally through the chassis (3).

37. The lift truck according to claim 36, characterized in that said pivoting units (39, 40) are operated or controlled to pivot their respective lifting members (17, 18) simultaneously and also such that said fork blades (17*b*, 18*b*) define or make the same angles with the center line (CL) and that said pivoting units (39, 40) are operated or controlled to pivot their respective lifting members (17, 18) individually for changing the angular position of one of said fork blades (17*b* or 18*b*) only relative to said center line (CL) or change the positions of said fork blades (17*b*, 18*b*) such that they are set in different angular positions relative to the centre line (CL).

38. The lift truck (1) according to claim 1, characterized in that each of said lifting members (17, 18) is in the form of a fetching means for fetching bales, rolls or plates.

39. The lift truck (1) according to claim 38, wherein each of said front portions (15*b* or 16*b*) of said lift arms (15, 16) includes a lower part (15*c* or 16*c*), said one of said lifting members (17, 18) being provided on one of said lower parts (15*c*, 16*c*) of said one of said front portions (15*b* or 16*b*) of said lift arms (15, 16), said another one of said lifting members (17, 18) being provided on another one of said lower parts (15*c*, 16*c*) of said another one of said front portions (15*b* or 16*b*) of said lift arms (15, 16).

40. The lift truck (1) according to claim 1, characterized in that each of said lifting members (17, 18) is in the form of a fetching arm for fetching bales, rolls or plates, a clamping device is provided between said fetching arms for clamping or gripping goods between said fetching arms such that said goods can be lifted.

41. The lift truck (1) according to claim 1, including a retaining device (10) for retaining said lifting arms (15, 16) at the chassis (3), characterized in that said retaining device (10) is located behind said driving compartment (2).

* * * * *

UNITED STATES PATENT AND TRADEMARK OFFICE

CERTIFICATE OF CORRECTION

PATENT NO. : 6,971,836 B2
DATED : December 6, 2005
INVENTOR(S) : Hans Carlsson

It is certified that error appears in the above-identified patent and that said Letters Patent is hereby corrected as shown below:

Column 10,
Line 55, after "claim" delete "21" and insert -- 1 --.

Column 11,
Line 20, after "or (1st occurrence)" change "20b" to -- 20a --.

Signed and Sealed this

Second Day of May, 2006

JON W. DUDAS
*Director of the United States Patent and Trademark Office*